US009235191B2

(12) United States Patent
Stranczl et al.

(10) Patent No.: US 9,235,191 B2
(45) Date of Patent: Jan. 12, 2016

(54) TIMEPIECE MECHANISM STRUCTURE

(71) Applicant: Nivarox-FAR S.A., Le Locle (CH)

(72) Inventors: Marc Stranczl, Nyon (CH); Thierry Hessler, St-Aubin (CH); Jean-Luc Helfer, Le Landeron (CH)

(73) Assignee: Nivarox-FAR S.A., Le Locle (CH)

( * ) Notice: Subject to any disclaimer, the term of this patent is extended or adjusted under 35 U.S.C. 154(b) by 39 days.

(21) Appl. No.: 14/204,160

(22) Filed: Mar. 11, 2014

(65) Prior Publication Data

US 2014/0286139 A1 Sep. 25, 2014

(30) Foreign Application Priority Data

Mar. 19, 2013 (EP) ..... 13160027

(51) Int. Cl.

| | |
|---|---|
| ***G04B 18/06*** | (2006.01) |
| ***G04B 15/14*** | (2006.01) |
| ***G04B 29/00*** | (2006.01) |
| ***G04B 31/00*** | (2006.01) |

(52) U.S. Cl.

CPC ..... *G04B 15/14* (2013.01); *G04B 29/00* (2013.01); *G04B 31/00* (2013.01); *Y10T 29/49581* (2015.01)

(58) Field of Classification Search

CPC ..... G04B 15/14; G04B 31/02; G04B 31/04; G04B 31/06; G04B 33/00–33/16

See application file for complete search history.

(56) References Cited

U.S. PATENT DOCUMENTS

| | | | | |
|---|---|---|---|---|
| 580,046 | A | 4/1897 | Harrington | |
| 3,146,582 | A * | 9/1964 | Loretan | 368/326 |
| 3,306,028 | A * | 2/1967 | Suzuki | 368/326 |
| 3,582,162 | A | 6/1971 | Baermann | |
| 3,712,051 | A * | 1/1973 | Romang et al. | 368/326 |
| 3,942,848 | A * | 3/1976 | Voumard | 384/125 |
| 5,369,627 | A * | 11/1994 | Ikegami | 368/88 |
| 5,416,752 | A * | 5/1995 | Ikegami | 368/88 |
| 6,520,108 | B1 | 2/2003 | Komura | |
| 7,234,859 | B2 * | 6/2007 | Kohler et al. | 368/326 |
| 8,926,170 | B2 * | 1/2015 | Helfer et al. | 368/326 |
| 2002/0114225 | A1 * | 8/2002 | Damasko | 368/125 |

(Continued)

FOREIGN PATENT DOCUMENTS

| | | |
|---|---|---|
| CH | 488 169 | 3/1970 |
| DE | 2 218 663 | 10/1973 |
| EP | 2 605 079 A1 | 6/2013 |
| EP | 2 605 087 A1 | 6/2013 |
| FR | 2 807 160 A1 | 10/2001 |
| JP | 51-49063 U | 4/1976 |

(Continued)

OTHER PUBLICATIONS

European Search Report issued Sep. 5, 2013, in Patent Application No. EP 13 16 0027, filed Mar. 19, 2013 (with English-language translation).

*Primary Examiner* — Amy Cohen Johnson
*Assistant Examiner* — Jason Collins
(74) *Attorney, Agent, or Firm* — Oblon, McClelland, Maier & Neustadt, L.L.P.

(57) ABSTRACT

A timepiece mechanism structure for receiving and guiding at least one pivoting wheel set is provided. The structure includes at least one inseparable single-piece structure, including one inseparable single-piece frame which includes pivot housings aligned in pairs in a direction of alignment for receiving the pivots of an arbour of this pivoting wheel set, and each pivot housing is an open housing formed by a half bearing or by a dihedral, and includes at one end a stop bearing surface in this direction of alignment.

16 Claims, 2 Drawing Sheets

(56) References Cited

U.S. PATENT DOCUMENTS

| | | | | |
|---|---|---|---|---|
| 2006/0187767 | A1* | 8/2006 | Conus et al. | 368/324 |
| 2011/0164478 | A1* | 7/2011 | Conus et al. | 368/324 |

FOREIGN PATENT DOCUMENTS

| | | | |
|---|---|---|---|
| NL | 11224 | | 12/1923 |
| WO | WO 2011161139 | A1 * | 12/2011 |

* cited by examiner

TIMEPIECE MECHANISM STRUCTURE

This application claims priority from European Patent application No. 13160027.2 filed Mar. 19, 2013, the entire disclosure of which is hereby incorporated by reference.

FIELD OF THE INVENTION

The invention concerns a timepiece mechanism structure for receiving and guiding at least one pivoting wheel set.

The invention also concerns a mechanical timepiece movement including at least one structure of this type.

The invention also concerns a method of producing a timepiece mechanism structure of this type for receiving and guiding at least one pivoting wheel set.

The invention concerns the field of timepiece mechanisms and more particularly movements integrating functional, ready-to-use modules, intended to be fitted with pivoting wheel sets requiring high quality geometry and positioning.

BACKGROUND OF THE INVENTION

Relative positioning and geometry, in particular the parallelism of the pivoting wheel set arbours, determines the precision, working and longevity of timepiece mechanisms.

The utilisation of modular assemblies requires, in particular, perfect precision, because of the stacked independently pre-assembled sub-assemblies.

The concept of extremely high precision modules or cassettes allows large scale production to be combined with high quality goods.

Thus, modular sub-assemblies for timepiece movements are known, from EP Patent Application Nos 11193173.9 and 11193174.7 in the name of ETA SA. The mechanical modules disclosed in these Patent Applications are irreversibly pre-adjusted and assembled to ensure the durability of their settings.

However, in a conventional embodiment, the modules do not always permit a reduction in the number of components, which would both reduce production costs and simplify the assembly plan, enabling mid-level technical personnel to assemble and adjust the most complex functions, while guaranteeing the required geometrical precision.

JP Patent No S5149063 discloses wheel sets including end pivots which pivot in bearings made in the same U-shaped plate. NL Patent No 11224C in the name of Watson discloses a similar configuration.

US Patent Application No. 580046A in the name of Harrington discloses a similar configuration with a U-shaped plate and a parallelism adjustment means using screws.

US Patent Application No. 2582162A in the name of Baermann discloses a magnetic electrical counter bearing including a U-shaped frame containing two aligned two bearings in which the counting wheel set pivots.

CH Patent Application No 488169A in the name of Rego discloses a pivoting device for a compass hand, with a cup bearing carrying two bearings.

DE Patent Application No 2218663A1 in the name of Mueller Schlenker FA discloses balance wheel half bearings with a vertical arbour for the lateral assembly of the balance, closed by a plate including a groove cooperating with a projecting portion of revolution of the balance.

FR Patent Application No 2807160A1 in the name of Denso Corporation discloses a case including aligned bores in which there is guided an arbour including, on one side, a trunnion made of resinous material, and on the opposite side, a hard metal trunnion of smaller diameter to that of the resinous trunnion.

SUMMARY OF THE INVENTION

Thus, the invention proposes to provide structures, in particular but not restrictively, for use in modules or cassettes, having a reduced number of components, with high quality geometry with regard to the arbour lines.

The present invention preferably uses new technologies for fabricating micro-components, MEMS, "LIGA", lithography, and suchlike, to optimise the fabrication of such structures.

Thus the invention concerns a timepiece mechanism structure for receiving and guiding at least one pivoting wheel set, characterized in that the structure includes at least one inseparable single-piece structure which includes at least one inseparable single-piece frame which includes pivot housings aligned in pairs in a direction of alignment for receiving the pivots of an arbour of at least one said pivoting wheel set, and in that each said pivot housing is an open housing formed by a half bearing or by a dihedral, and includes at one end a stop bearing surface in said direction of alignment.

According to a feature of the invention, said structure also includes at least one cover arranged to cooperate with said at least one frame in order, in the closure position of said at least one cover on said at least one frame, to confine with minimum play each said arbour of each said pivoting wheel set comprised in said structure, and characterized in that said structure includes, on said at least one frame and/or said at least one cover, a flexible play take-up means for confining each said arbour without play.

The invention also concerns a mechanical timepiece movement including at least one structure of this type.

The invention further concerns a method of making a timepiece mechanism structure of this type for receiving and guiding at least one pivoting wheel set, characterized in that said inseparable single-piece structure is fitted with an integrated elastic return means made in a single piece therewith, either for holding without play at least one said arbour of at least one said pivoting wheel set, and/or for forming at least one elastic shock absorber, and/or for allowing the position of a bearing carrier to be adjusted, and in that said single-piece inseparable structure is made of silicon, and in that said integrated elastic return means comprised therein is prestressed in an oxidised silicon state. The advantage of making single-piece components, in particular with the plate or the bridges, is that the number of parts is reduced and assembly problems are avoided.

The invention benefits from the precision with which these monolithic components are made (typically, the parts are for example made of silicon and therefore enjoy micrometric precision).

The monolithic structure has the main advantage of guaranteeing the distances between centres and forming a ready-to-use mechanism, in particular an oscillator in a preferred application.

The invention incorporates, in particular, flexible guide members, which have the following advantages:

- guaranteed precision;
- very reduced or zero friction level;
- no hysteresis in the movements, due to the absence of friction or at least the extremely reduced level of friction;
- no lubrication;
- no play;
- no wear.

The manufacture of the flexible guide members results in limitations, notably a limited travel, low return forces, and a limited charge. However, these limitations are not prohibitive for a number of horological functions, in particular those which relate to regulation.

These limitations are amply compensated for by the high precision of the distance between centres, the small number of components to be made and hence the reduced complexity and assembly time. A structure according to the invention has a great industrial advantage: the mechanism, particularly an oscillator, assembled in combination with a structure of this type, forms a component ready for assembly in a movement. Further, there is nothing to prevent an entire movement being devised in the form of a structure of the invention.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
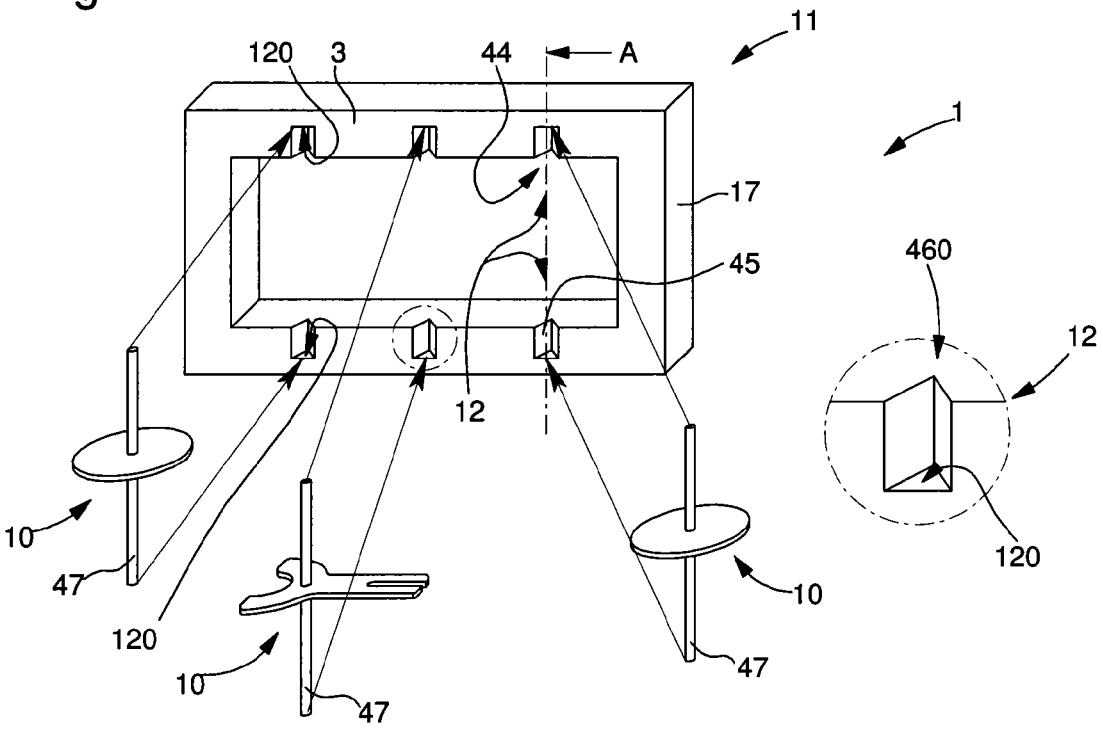
FIG. 1 shows a perspective view of a structure according to the invention including a non-deformable single-piece frame which includes housings aligned in pairs forming pivots for receiving the ends of pivoting wheel set arbours.

The invention concerns the field of timepiece mechanisms, and more specifically movements integrating functional, ready-to-use modules.

The invention concerns a timepiece mechanism structure 1 for receiving and guiding at least one pivoting wheel set 10 including at least one arbour 47 including pivot guiding supports. Naturally, this type of wheel set 10 may also include only end guiding supports, with no shafted portion over the entire length thereof, this description however uses the term "arbour 47" for the sake of simplification, to designate the guiding supports or pivots comprised in pivoting wheel set 10.

According to the invention, this structure 1 includes at least one inseparable single-piece structure 11, which includes at least one inseparable single-piece frame 17, which includes pivot housings 12 aligned in pairs for receiving the pivots of an arbour 47 of at least one pivoting wheel set 10.

Each said pivot housing 12 is an open housing formed by a half bearing or by a dihedral, and includes at one end a stop bearing surface 120 in direction of alignment A.

The description is deliberately restricted, for the sake of conciseness, to this particular preferred case of a pivot guiding support for pivoting wheel sets. Those skilled in the art will understand the advantage of the invention for other applications, in particular for immobilising non-pivoting components confined within a non-deformable structure.

In a preferred embodiment, as shown in the Figures, this single-piece inseparable structure 11 includes at least one single-piece inseparable frame 17, which includes, forming a top bearing 44 and a bottom bearing 45, pivot housings 12 aligned in pairs for receiving the pivots of at least one pivoting wheel set 10.

Figure 2:
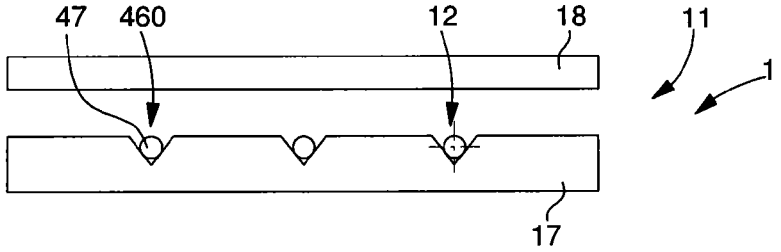
FIGS. 2 and 3 are top views illustrating the cooperation of a cover with this frame, respectively in the open and closed positions, for immobilising the arbour ends.
Figure 3:
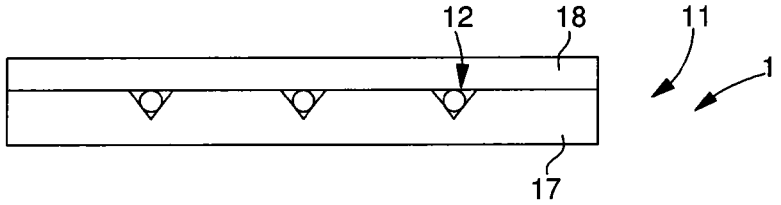
Figure 4:
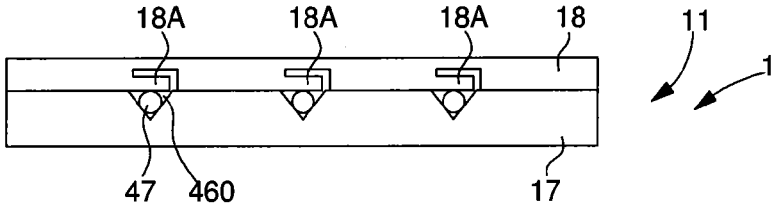
FIG. 4 illustrates an advantageous cover variant with flexible play take-up strips.

In the advantageous embodiment of FIGS. 2 to 4, structure 1 further includes at least one cover 18, which is arranged to cooperate with said at least one frame 17 in order, in a closure position of said at least one cover 18 on said at least one frame 17, to confine with minimum play each said arbour 47 of each said pivoting wheel set 10 comprised in structure 1. For reasons of assembly convenience, or to leave functional interface passages with the rest of the movement, for example to allow a gear train or suchlike to pass through, it may be necessary to juxtapose several covers 18 for the same non-deformable single-piece structure 17 or vice versa, or to join several structures 17 via several covers 18.

In a particular variant, at least one cover 18 is made in a single-piece with a frame 17, to which it is connected by a flexible fastening, and onto which it is folded down after insertion of the pivoting wheel set(s) 10 or suchlike.

Advantageously, cover 18 is irreversibly secured to frame 17 by welding, brazing, laser welding, bonding, rivets or other means, to form together the inseparable single-piece structure 11, after pivoting wheel sets 10 have been assembled confined in position in pivot housings 12.

In a particular embodiment (not illustrated), structure 1 incorporates a plate and/or at least one bridge, forming frame 17 or inseparably attached thereto. Frame 17 may also be independent of the plate and of the bridge, and be fixed to one or the other, or to both at the same time.

Figure 5:
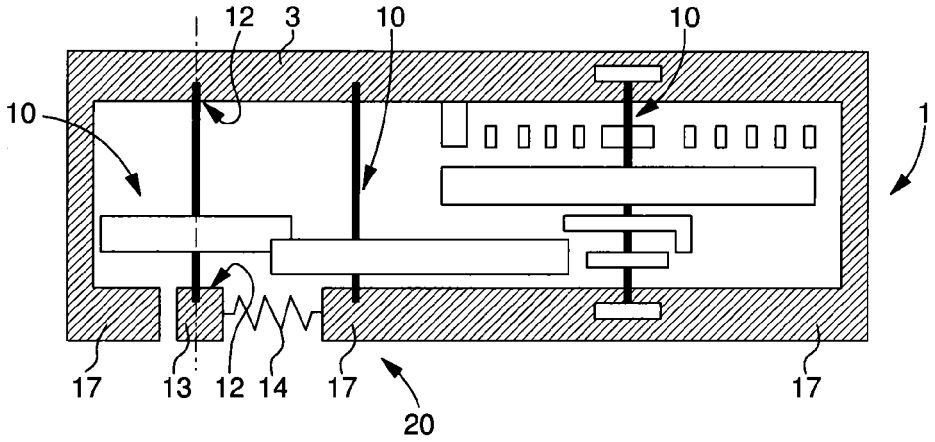
FIG. 5 shows, in a similar manner to FIG. 1, a variant wherein at least one of the pivoting wheel sets mounted in the structure is pivoted at at least one of the ends thereof in a bearing carrier connected to the single-piece frame by an integrated elastic return means, and can be clamped in position.

Particularly, as in FIGS. 1 and 5, frame 17 is a closed frame, and notably a closed rectangular frame.

Advantageously, structure 1 includes a flexible play take-up means 18A, for confining without play each said arbour 47 of each said pivoting wheel set 10 comprised in cassette 1. FIG. 4 illustrates an example embodiment of cover 18 with elastic lips 18A performing the play take-up. This flexible play take-up means may be fitted either to frame 17 or equally to cover 18.

In an embodiment shown in FIGS. 1 to 4, at least one pivot housing 12 is a dihedral 460.

Figure 7:
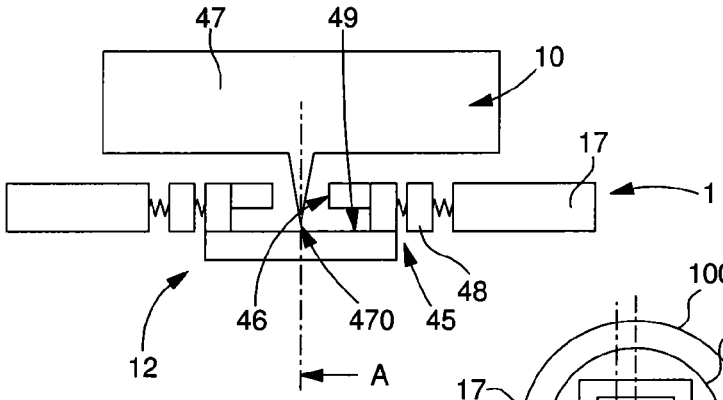
FIG. 7 shows a cross-section through the arbour of a particular pivot with a shock absorber bearing integral with the single-piece frame.
Figure 8:
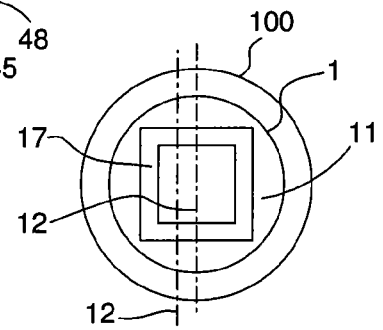
FIG. 8 is a diagram of a timepiece movement including a structure according to the invention.

FIG. 7 illustrates a particular case where structure 1 includes at least one pivot housing 12 which includes a shoulder of revolution 46 for radially holding arbour 47 of pivoting wheel set 10, and stop bearing surface 120 is a frontal shoulder 49 for axially limiting the end of arbour 47, said shoulder of revolution 46 and/or said frontal shoulder 49 being carried by at least one resilient shock absorber 48. In FIG. 7, shoulder of revolution 46 and frontal shoulder 49 are carried together by at least one resilient shock absorber 48.

In a variant which is not illustrated, shoulder of revolution 46 or frontal shoulder 49 is carried by its own shock absorber.

In a variant which is not illustrated, shoulder of revolution 46 and frontal shoulder 49 are carried separately by a shock absorber, which may be a common shock absorber with two bearing surfaces, or multiple shock absorbers, with each shoulder being carried by its own shock absorber.

In another variant, shoulder of revolution 46 and frontal shoulder 49 are carried together by a resilient shock absorber 48.

In a particular variant embodiment, this resilient shock absorber 48 is in a single piece with inseparable single-piece structure 11 and particularly with frame 17.

In another particular variant embodiment, this shoulder of revolution 46 and/or this frontal shoulder 49 is in a single piece with frame 17.

In yet another particular variant embodiment, this resilient shock absorber 48, shoulder of revolution 46 and/or frontal shoulder 49 are all in a single piece with inseparable single-piece structure 11 and particularly with frame 17.

In a particular embodiment, inseparable single-piece structure 11 is made of silicon, and the integrated elastic return means comprised therein is pre-stressed in an oxidised silicon state.

In a particular embodiment, frame 17 is made of silicon, and the integrated elastic return means comprised therein is pre-stressed in an oxidised silicon state.

Pivots 44, 45 may be formed by conventional pivots or by flexible guiding supports.

The design of structures 1 according to the invention including inseparable single-piece components 17 also optimises the pivoting of the various wheel sets and, as required, ensures the parallelism thereof, or conversely permits at least one end of a wheel set arbour to be moved to perform a micrometric setting adjustment.

The action on the pivot housings permits, in particular, the distance of centres between the wheel sets to be adjusted to adjust the penetration of the toothings and/or pallet stones. The distance of centres adjustment may be carried out in a monolithic manner with the plate or the bridge. This principle of adjusting the distance between centres is valid for all the distances between centres in a movement.

Figure 6:
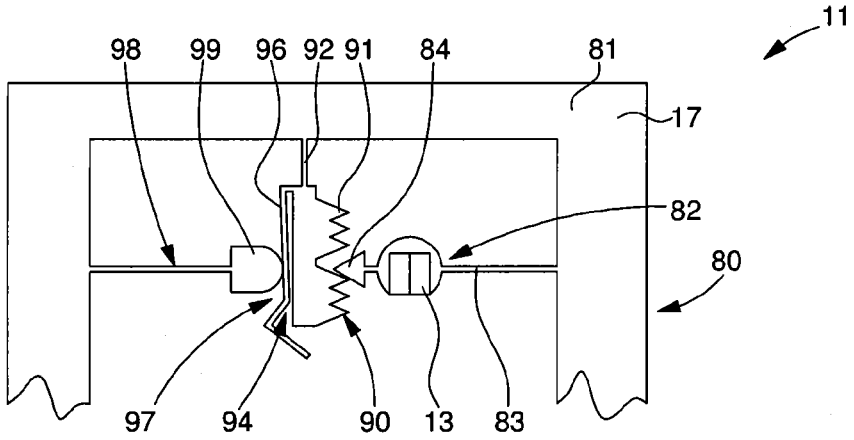
FIG. 6 shows a plan view of a monolithic assembly of this type including a position adjustment means of a bearing carrier integrated in the structure, the adjustment means being able to be locked in position via clamping means; the adjustment means includes a comb immobilising an index located at the end of a flexible strip, the comb being pressed onto said index by a strip spring clamp which is in turn immobilised by a locking finger.

In the particular embodiment of FIGS. 5 and 6, one said pivot housing 12 is integral with a bearing carrier 13 connected to frame 17 by elastic return means 14 and 83 respectively.

In a particular embodiment, the pivot housings 12 have a constant position relative to the at least one inseparable single-piece structure 11.

In another embodiment, at least one pivot housing 12 is suspended, particularly to enable the energy from a shock to be absorbed, and to return to the operating position.

FIG. 5 thus illustrates an elastic return means 14 which has sufficient rigidity to ensure, at rest, the precise positioning of pivot housing 12, and which is devised to absorb any shocks and then return the arbour to its position. In this FIG. 5 variant, at least one pivoting wheel set 10 is pivoted, at at least one end thereof, in a pivot 45, forming housing 460, which is housed in a bearing carrier 13. This bearing carrier 13 is connected to frame 17 by this integrated elastic return means 14, which is preferably in a single piece with both frame 17 and with the respective bearing carrier 13.

Naturally, it is also possible to envisage a variant wherein this component is pivoted at both ends in suspended bearing carriers.

The elastic return means 14 allows a range of adjustment, the return means is preferably associated with a post adjustment position locking means, an example of which is given in the present description in the particular case of FIG. 6. Advantageously, this position locking means is also made in a single piece with frame 17 and with the respective bearing carrier 13.

For a particularly advantageous application to a mechanism which is adjustable and lockable, notably in a reversible manner, but which can also be immobilised (notably irreversibly) after an initial adjustment, structure 1 includes a position adjustment mechanism 80, preferably on frame 17, as seen in FIG. 6.

FIG. 6 therefore illustrates a particular arrangement, wherein a bearing carrier 13 is mounted integrally with a position adjustable component, and can be locked in position once adjusted. In this variant, the inseparable single-piece structure 11 includes a position adjustment mechanism 80 of a position adjustable component 82 including a bearing carrier 13 connected to frame 17 by elastic return means 83. This mechanism 80 includes a rigid structure 81, preferably formed by frame 17. This rigid structure 81 carries, via at least one elastic strip 83, the position adjustable component 82, which here carries a bearing carrier 13, and which in turn includes an indexing means 84 arranged to cooperate with a complementary indexing means 91 comprised in an adjustment mechanism 90. This complementary indexing means 91 is detachably mounted to indexing means 84. It can also be locked in a cooperating position by a clamping mechanism 94 resiliently secured to structure 81. This clamping mechanism 94 is resiliently secured to structure 81 by at least one flexible element 96 and is in turn subject to the action of a locking mechanism 98 which allows mechanism 94 to occupy either a detached position in which adjustment mechanism 90 is free, or an engaged position in which clamping mechanism 94 hinders adjustment mechanism 90.

This locking mechanism includes at least one flexible element 98 forming a jumper and resiliently secured to structure 81, said at least one flexible element 98 here includes a beak 99 which cooperates with a beak 97 of clamp 94 to hold the clamp away during the position adjustment, or with a complementary stop surface 95 of clamp 94 as security for the clamp when the position adjustment is carried out.

FIG. 6 illustrates a mechanism of this type with a comb 91 immobilising an index 84 located at the end of a flexible strip 83, comb 91 being pressed onto index 84 by a strip-spring clamp 96 belonging to clamp 94, which is in turn immobilised by a locking finger 99 mounted on at least one flexible strip 98, said finger 99 cooperating with a stop surface 97 of strip 96.

As seen above, this combined adjustment, clamping and locking mechanism, illustrated here for a particular application of adjusting a bearing position, for example to perform a micrometric correction to the working of a regulator mechanism, is applicable to a wide range of applications: positioning a bearing, a stop member, or other element.

In an advantageous embodiment, structure 1 and/or frame 17 is made of silicon. The pivot housings of housings 460 are defined, for example, by anisotropic (KOH) etches in a silicon substrate. A version with an assembly of jewels or shock absorbers is also possible. The great advantage is the very precise positioning of the pivot housings (distance from centres, verticality). It is noted that placing cover 18 in position does not disrupt the positioning of the various arbours.

For a particular application to an escapement mechanism, depending upon the configuration thereof, structure 1 incorporates all or part of the guide bearings for the wheel set arbours:

the two pivot housings of the pallet lever and all of the bottom bearings of the other wheel sets;

the two pivot housings of the balance, and of the pallet lever, and all of the bottom bearings of the other wheel sets;

the two pivot housings of the balance and all of the bottom bearings of the other wheel sets.

In another particular embodiment of the invention, frame 17 forms an inseparable single piece component with at least one shock absorber bearing for receiving a pivot of a component of the mechanism incorporated in structure 1, particularly an escape mechanism.

The shock absorbers may thus be partially or totally made inside frame 17: the shock absorber spring may be made jointly with frame 17. One of the two (or both) jewels may be made jointly with the plate. The pivoting then occurs directly in the silicon. The pivot housings 12 may be made straight in the silicon with DLC or other surface coatings. There are thus no more jewels and the points of rotation are very precisely positioned.

In a particular embodiment, structure 1 includes severable elements intended to facilitate the assembly of the structure in a larger assembly, these severable elements then only have to be broken off to give one or more degrees of freedom to certain of the constituents thereof.

In an advantageous embodiment of cassette 1 according to the invention, structure 1 is made of micromachinable material, or silicon, or oxidised silicon, and the integrated elastic returns means comprised therein is pre-stressed in an oxidised silicon state. Other materials in MEMS or "LIGA" technology may be employed. Quartz, DLC, at least partially amorphous materials or metallic glasses, may be used for these applications, although the list is not limiting.

A particular structuring of structure 1 can compensate for the effects of expansion of these structural elements, or of the components of the mechanism assembled therewith. It is, for example, possible to make the plate in silicon, and then oxidise it, for the sake of consistency.

The invention also concerns a mechanical timepiece movement 100 including at least one structure 1 of this type.

The invention further concerns a method of making a timepiece mechanism structure 1 of this type for receiving and guiding at least one pivoting wheel set 10. According to the invention, the inseparable single-piece structure 11 is provided with integrated elastic return means in a single piece therewith, either for holding, with no play, at least one arbour 47 of at least one pivoting wheel set 10, and/or for forming at least one resilient shock absorber 48 and/or for adjusting the position of a bearing carrier 13. The inseparable single-piece structure 11 is made of silicon, and said integrated elastic return means is pre-stressed in an oxidised silicon state.

In a variant, pivot housings 12 are made straight in the silicon with DLC surface coatings.

In a variant, inseparable single-piece structure 11 is made with at least one inseparable single-piece frame 17 including pivot housings 12 aligned in pairs for receiving the pivots of at least one said pivoting wheel set 10, and these pivot housings 12 are made by anisotropic etches in a silicon substrate.

In a variant, inseparable single-piece structure 11 is formed with frame 17 and a cover 18 together confining the wheel sets 10 in position in pivot housings 12, and frame 17 and cover 18 are irreversibly secured to each other by welding or soldering or bonding or rivets or by laser welding to form an inseparable single-piece assembly.

The high precision provided by the invention allows the components and thus the movement to be thinned. The invention is thus particularly useful for making ultra-flat movements.

What is claimed is:

1. A timepiece mechanism structure to receive and guide at least one pivoting wheel set, the structure comprising:

at least one inseparable single-piece structure, which includes at least one inseparable single-piece frame which includes pivot housings aligned in pairs in a direction of alignment to receive pivots of an arbour of at least one said pivoting wheel set, and each said pivot housing is an open housing formed by a half bearing or by a dihedral, and includes at one end a stop bearing surface in said direction of alignment, wherein the at least one said inseparable single-piece structure includes a position adjustment mechanism for a position adjustable component including a bearing carrier connected to said frame by an elastic return mechanism, said position adjustment mechanism including a rigid structure carrying, via at least one resilient strip, said position adjustable component which further includes an indexing mechanism arranged to cooperate with a complementary indexing mechanism comprised in an adjustment mechanism, said complementary indexing mechanism being detachably mounted to the indexing mechanism and being lockable in a cooperating position by a clamping mechanism resiliently secured to said rigid structure, said clamping mechanism being in turn subject to an action of a locking mechanism which allows said clamping mechanism to occupy either a detached position wherein said adjustment mechanism is free, or an engaged position wherein said clamping mechanism hinders said adjustment mechanism, said locking mechanism also being resiliently secures to said rigid structure.

2. The timepiece mechanism structure according to claim 1, wherein said timepiece mechanism structure also includes at least one cover arranged to cooperate with said at least one frame in order, in a closure position of said at least one cover on said at least one frame, to confine with minimum play each said arbour of each said pivoting wheel set comprised in said timepiece mechanism structure, and wherein said timepiece mechanism structure includes, on said at least one frame and/or said at least one cover, a flexible play take-up mechanism to confine each said arbour without play.

3. The timepiece mechanism structure according to claim 2, wherein said inseparable single-piece structure is formed by said frame and said cover together confining said pivoting wheel sets in position in said pivot housings, said frame and said cover forming an inseparable single-piece assembly.

4. The timepiece mechanism structure according to claim 1, wherein said frame is a closed frame.

5. The timepiece mechanism structure according to claim 1, wherein at least one said pivot housing is a dihedral.

6. The timepiece mechanism structure according to claim 1, wherein at least one said pivot housing includes a shoulder of revolution to radially hold one said arbour, and said stop bearing surface is a frontal shoulder to axially limit the axial end of said arbour, said shoulder of revolution and/or said frontal shoulder being carried by at least one resilient shock absorber.

7. The timepiece mechanism structure according to claim 6, wherein said shoulder of revolution and said frontal shoulder are carried together by the at least one resilient shock absorber.

8. The timepiece mechanism structure according to claim 6, wherein the at least one said resilient shock absorber is in a single piece with said inseparable single-piece structure.

9. The timepiece mechanism structure according to claim 6, wherein said shoulder of revolution and/or said frontal shoulder is in a single-piece with said inseparable single-piece structure.

10. The timepiece mechanism structure according to claim 1, wherein at least one said pivot housing is integral with a bearing carrier connected to said frame by said elastic return mechanism.

11. The timepiece mechanism structure according to claim 1, wherein said pivot housings include a constant position relative to said at least one inseparable single-piece structure.

12. The mechanical timepiece movement including at least one timepiece mechanism structure according to claim 1.

13. A method of forming a timepiece mechanism structure to receive and guide the at least one pivoting wheel set according to claim 1, wherein said inseparable single-piece structure is fitted with an integrated elastic return mechanism in a single-piece therewith, either to hold without play at least one said arbour of at least one said pivoting wheel set, and/or to form at least one resilient shock absorber, and/or to allow adjustment of position of a bearing carrier, and said inseparable single-piece structure is made of silicon, and said integrated elastic return mechanism comprised therein is prestressed in an oxidized silicon state.

14. The method according to claim 13, wherein said pivot housings are made straight in the silicon with DLC surface coatings.

15. The method according to claim 13, wherein said inseparable single-piece structure is made with at least one inseparable single-piece frame including pivot housings aligned in pairs to receive the pivots of at least one said pivoting wheel set, and said pivot housings are made by anisotropic etches in a silicon substrate.

16. The method according to claim 15, wherein said inseparable single-piece structure is formed with said frame and a cover together confining said pivoting wheel sets in a position in said pivot housings, and said frame and said cover are irreversibly secured to each other by welding or soldering or bonding or rivets or by laser welding to form an inseparable single-piece assembly.

* * * * *